US005435051A

United States Patent [19]

Cheremshynski

[11] Patent Number: 5,435,051

[45] Date of Patent: Jul. 25, 1995

[54] METHOD OF CONNECTING A DOWN SPOUT EXTENSION TO AN EAVE TROUGH DOWN SPOUT

[76] Inventor: David L. Cheremshynski, 6116-154 Avenue, Edmonton, Alberta, Canada, T5Y 2M8

[21] Appl. No.: 149,648

[22] Filed: Nov. 9, 1993

[30] Foreign Application Priority Data

May 14, 1993 [CA] Canada ..... 2096294

[51] Int. Cl.[6] ..... F16L 27/00

[52] U.S. Cl. ..... 29/436; 52/16; 137/615; 222/533; 285/184

[58] Field of Search ..... 29/436; 52/16; 137/403, 137/615; 285/184; 222/533

[56] References Cited

U.S. PATENT DOCUMENTS

| | | | |
|---|---|---|---|
| 468,870 | 2/1892 | Griswold | 222/533 |
| 625,339 | 5/1899 | Krueger | 137/403 X |
| 2,739,778 | 3/1956 | Krone et al. | 285/184 X |
| 2,739,779 | 3/1956 | Krone et al. | 285/184 X |
| 3,351,036 | 11/1967 | Paoli | 222/533 X |
| 3,375,851 | 4/1968 | Henry et al. | 137/615 X |
| 3,416,204 | 12/1968 | Waddington | 222/533 X |
| 3,911,954 | 10/1975 | Johnson | 285/184 X |

FOREIGN PATENT DOCUMENTS

| | | | |
|---|---|---|---|
| 1022320 | 12/1977 | Canada | 20/106.1 |
| 1169224 | 6/1984 | Canada | 20/106.1 |
| 1188476 | 6/1985 | Canada | 20/106.1 |

*Primary Examiner*—Joseph M. Gorski
*Attorney, Agent, or Firm*—Anthony R. Lambert

[57] ABSTRACT

A method of connecting a down spout extension to an eave trough down spout. Firstly, pivotally connect a down spout extension to a lowermost end of an eave trough down spout such that the down spout extension is movable between a substantially vertical stored position and a substantially horizontal operative position. Secondly, position a spring at the connection of the down spout extension and the eave trough down spout biasing the down spout extension into the stored position. The spring tension is set such that a flow of water through the down spout provides a force to overcome the biasing force of the spring thereby moving the down spout extension to the operative position.

2 Claims, 4 Drawing Sheets

METHOD OF CONNECTING A DOWN SPOUT EXTENSION TO AN EAVE TROUGH DOWN SPOUT

The present invention relates to a method of connecting a down spout extension to an eave trough down spout.

BACKGROUND OF THE INVENTION

Almost every building that has a sloped roof has an eave trough to catch rain water running down the slope of the roof. Down spouts are positioned at intervals to drain water from the eave trough. In some neighbourhoods the down spouts are connected directly into a neighbourhood storm sewer system. In other neighbourhoods the down spouts drain water from the eaves trough onto the lot. It is undesirable to have water from the eaves trough discharged immediately adjacent a foundation of a building as water may seep through the foundation into the basement. A practise has, therefore, developed of having down spout extensions direct water away from the foundation of the house. These down spout extensions are generally pivotally connected to the lowest portion of the down spout. They pivot from a substantially vertical stored position to a substantially horizontal operative position. A stored position is required as, in their operative position, the down spout extensions extend across sidewalks, and other areas where they are unsightly and may present a hazard. The down spout extensions must be moved to the operative position when rain is forecast and returned to a stored position when they are no longer required. A number of patents relate to down spout extensions which are pivotable between a stored and an operative position. Canadian Patent 1,169,224 which issued to MacDonald and Johnson in 1984 discloses a trough extension provided with flexible rubber or elastomeric portions or knobs which engage the vertical downspout holding the trough extension frictionally in position without marring the downspout. Canadian Patent 1,188,476 which issued to Busat in 1985 discloses a bracket attachable to a downspout with a pair of arms extending outwardly from the bracket to engage and retain the pivotally mounted discharge conduit in a vertical position.

There are many occasions when this is not convenient and the down spout extensions do not get placed in an operative position before the rain, or do not get returned to a stored position promptly after the rain. Canadian Patent 1,022,320 which issued to Felsen in 1977 discloses a downspout with a pivotable extension movable between a stored and an operative position by means of an electric motor. The electric motor being activated by a humidity sensor to move the extension to an operative position when the humidity rises above a preset plateau.

SUMMARY OF THE INVENTION

What is required is an improved method of connecting a down spout extension to an eave trough down spout which will pivot the down spout extension to an operative position in the event of rain.

According to the present invention there is provided a method of connecting a down spout extension to an eave trough down spout which includes the following steps. Firstly, pivotally connect a down spout extension to a lowermost end of an eave trough down spout such that the down spout extension is movable between a substantially vertical stored position and a substantially horizontal operative position. Secondly, positioning a spring at the connection of the down spout extension and the eave trough down spout biasing the down spout extension into the stored position. The spring tension is set such that a flow of water through the down spout provides a force to overcome the biasing force of the spring thereby moving the down spout extension to the operative position.

When the teachings of the described method are followed, the down spout extension is lowered by the force of a torrent of water flowing from the eaves trough down spout during a heavy rain. As long as the flow continues the down spout extension remains in the operative position. Upon the flow diminishing the biasing force of the spring returns the down spout extension to a stored position.

Although beneficial results may be obtained by following the teaching of the method as described, it is difficult to find set tension in a spring which is sensitive enough to lower the down spout extension to the operative position during a light rain and also strong enough to return the down spout extension to the stored position. This is especially so in view of leakage which inevitably occurs at the connection between the down spout extension and the eaves trough down spout. Even more beneficial results may, therefore, be obtained by when means is provided to seal the connection between the down spout extension and the eave trough down spout thereby preventing water flowing from the eave down spout from bypassing the down spout extension.

When the connection between the down spout extension and eaves trough down spout is sealed, the volume of water flow from the rain does not effect operation. If the rain is light water will merely accumulate until the weight of the accumulated water is sufficient to overcome the biasing force of the spring to move the down spout extension to the operative position. Once the accumulated water is drained the biasing force of the spring returns the down spout extension to the stored position. One effective form of sealing means is an external or internal sleeve.

BRIEF DESCRIPTION OF THE DRAWINGS

These and other features of the invention will become more apparent from the following description in which reference is made to the appended drawings, wherein.

DETAILED DESCRIPTION OF THE PREFERRED EMBODIMENT

The preferred method of connecting a down spout extension to an eave trough down spout will now be described with reference to FIGS. 1 through 6.

Figure 1:
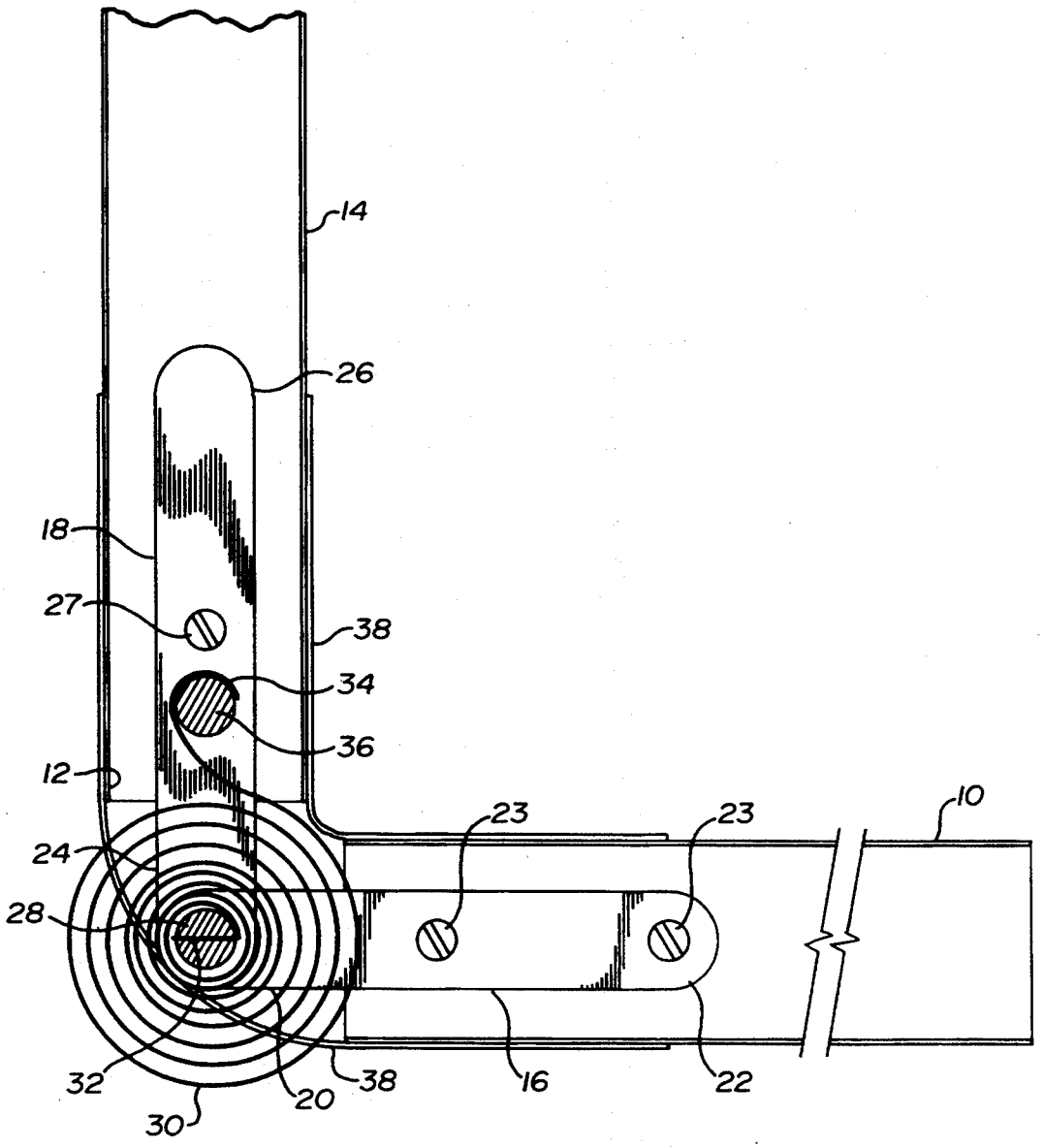
FIG. 1 is a side elevation view in longitudinal section of a down spout extension connected to an eaves trough down spout in accordance with the present method in the operative position.
Figure 2:
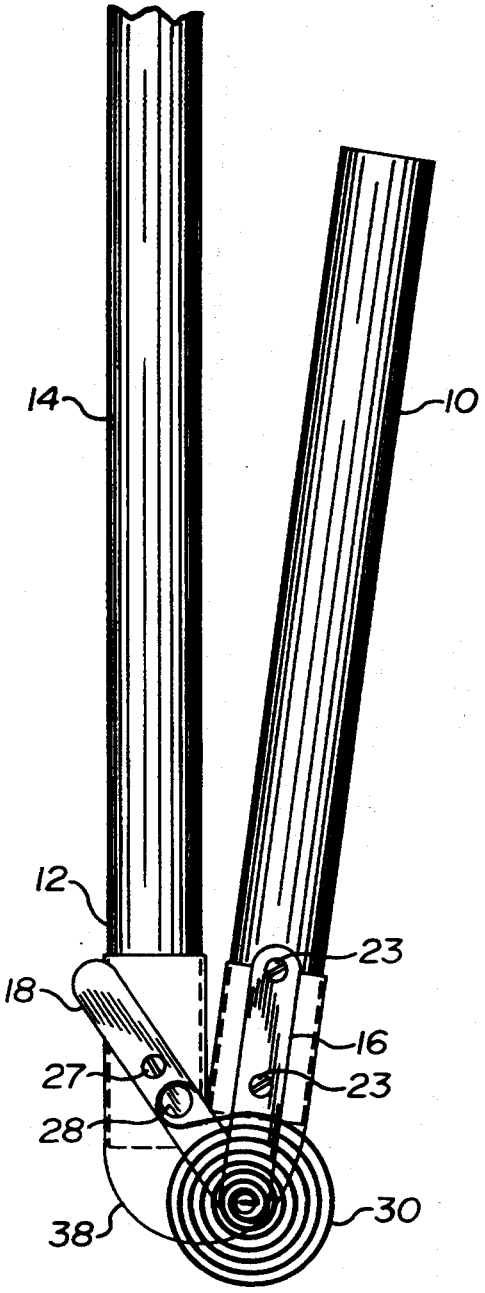
FIG. 2 is a side elevation view in longitudinal section of a down spout extension connected to an eaves trough down spout in accordance with the present method in the stored position.
Figure 3:
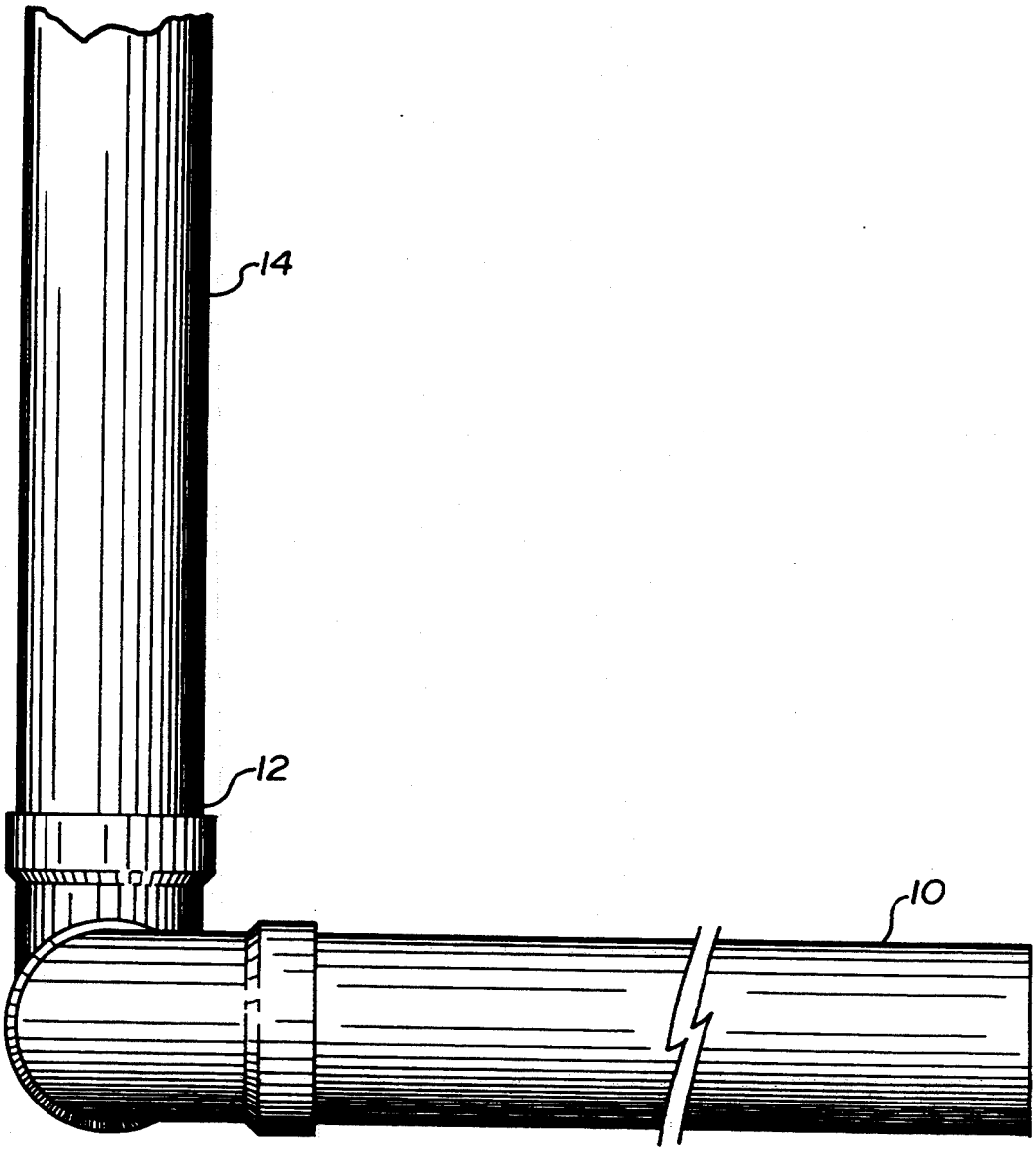
FIG. 3 is side elevation view of an alternate form of down spout extension connected to an eaves trough down spout in accordance with the present method in the operative position.
Figure 4:
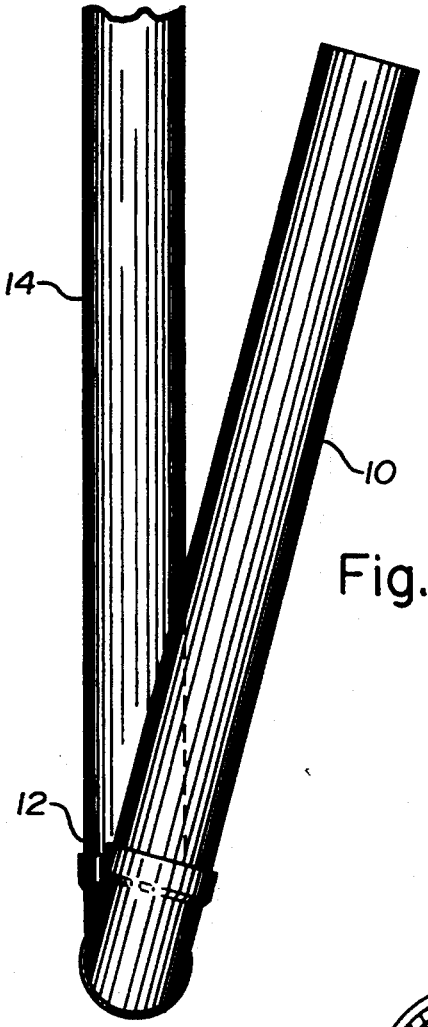
FIG. 4 is side elevation view of an alternate form of down spout extension connected to an eaves trough down spout in accordance with the present method in the stored position.

The method includes the following steps. Firstly, pivotally connect a down spout extension 10 to a lowermost end 12 of an eave trough down spout 14. When connected down spout extension 10 is movable between a substantially vertical stored position as illustrated in FIGS. 2 and 4, and a substantially horizontal operative position, as illustrated in FIGS. 1 and 3. The preferred form of pivotal connection includes a first arm 16 and a second arm 18. First arm 16 has a first end 20 and a second end 22. Second arm 18 has a first end 24 and a second end 26. First end 20 of first arm 16 is pivotally connected at a pivot point represented by peg 28 to first end 24 of second arm 18. Second end 22 of first arm 16 is secured to down spout extension 10 by means of screws 23. Second end 26 of second arm 18 is secured to eaves trough down spout 14 by means of screws 27. Secondly, position a spring 30 at the connection of down spout extension 10 and eave trough down spout 14. Spring 30 biases down spout extension 10 into the stored position as illustrated in FIG. 2. Spring 30 has a first end 32 and a second end 34. First end 32 is connected to peg 28 on first arm 16. Second end 34 is connected to a peg 36 on second arm 18. Thirdly, it is preferred that a sleeve 38 be positioned over the connection between down spout extension 10 and eave trough down spout 14. The intent is to prevent water flowing from eave trough down spout from 14 bypassing down spout extension 10. Spring 30 is selected with tension suited to the size and weight of down spout extension 10. The intent is that an accumulation of water in down spout extension 10 will provide a sufficient weight to overcome the biasing force of spring 30 thereby moving the spout extension 10 to the operative position to drain the accumulation of water. Once the accumulation of water is drained the biasing force of spring 30 returned down spout extension 10 to the stored position. In a heavy rain the constant flow of a volume of water through down spout extension 10 maintains down spout extension continuously in the operative position. In a light rain down spout extension will move to the operative position at intervals to dump accumulations of water.

Figure 5:
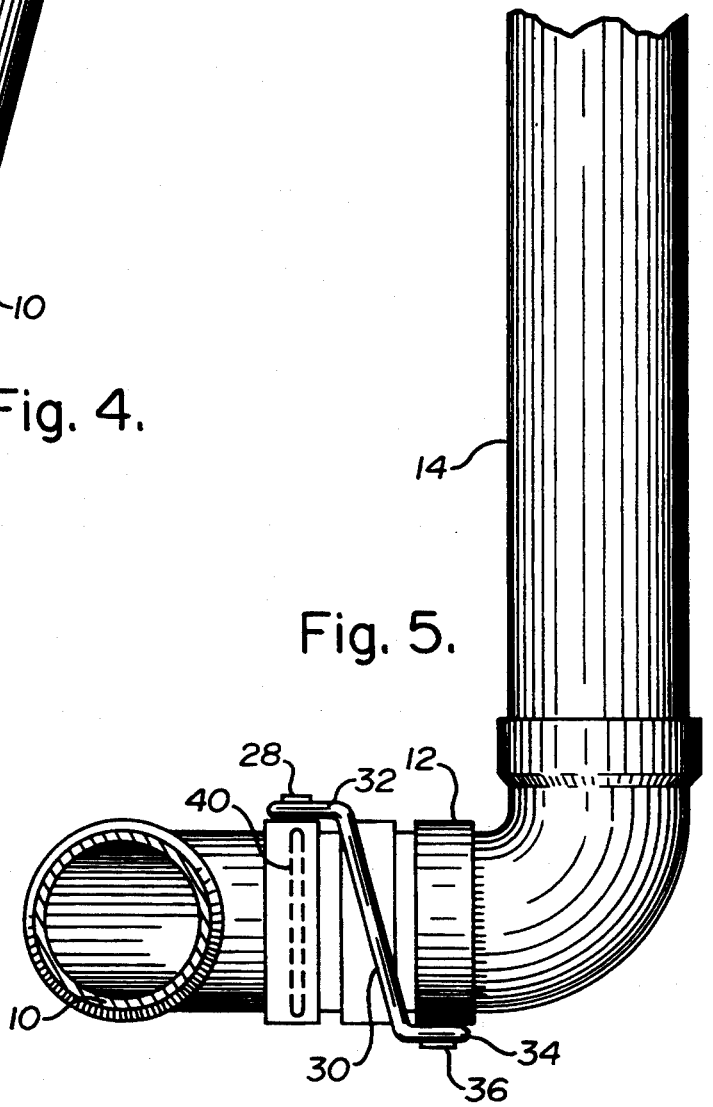
FIG. 5 is a end elevation view partially in section of the alternate form of down spout extension illustrated in FIGS. 3 and 4.
Figure 6:
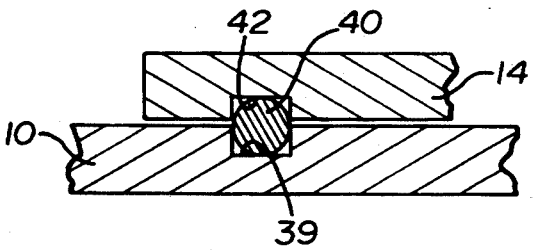
FIG. 6 is a detailed view of a portion of the down spout extension illustrated in FIG. 5.

An alternative form of down spout extension 10 is illustrated in FIGS. 3 through 6. The alternative embodiment illustrates an alternative manner of following the teachings of the present invention. There is illustrated an alternative manner of pivotally mounting down spout extension 10 to eave trough down spout 14. The alternative embodiment is illustrated in an operative position in FIG. 3, and in a stored position in FIG. 4. Referring to FIG. 5, there is illustrated an alternative form of biasing down spout extension 10 in which spring 30 is mounted externally. First end 32 of spring 30 is connected to peg 28 on down spout extension 10; second end 34 is connected to a peg 36 on eaves trough down spout 14. Referring to FIGS. 5 and 6, there is illustrated an alternative means to sleeve 38 of sealing the connection between down spout extension 10 and eave trough down spout 14 to prevent water flowing from eave down spout 14 from bypassing down spout extension 10. Down spout extension 10 and eave trough down spout 14 are in the form of tubular members which have a male to female type of telescopic connection. The male member, which as illustrated is down spout extension 10, has an exterior annular seal groove 39 at one end in which is positioned an "O" ring type of seal 40. "O" ring 40 is received in an interior annular groove 42 within the female member, which as illustrated is eaves trough down spout 14. The alternative embodiment works in a like manner to the first described embodiment according to the teachings of the present method.

It will be apparent to one skilled in the art that modifications may be made to the illustrated embodiment without departing from the spirit and scope of the invention as defined by the claims.

The embodiments of the invention in which an exclusive property or privilege is claimed are as follows:

1. A method of connecting a down spout extension to an eave trough down spout, comprising the steps of:

a. firstly, pivotally connecting a substantially right angle tubular down spout extension to a lowermost substantially horizontally positioned end of a substantially right angle tubular eave trough down spout in a telescopic male/female engagement, the down spout extension being pivotally movable relative to said eave trough down spout between a substantially vertical stored position and a substantially horizontal operative position;

b. secondly, positioning an external spring at the junction of the down spout extension and the eave trough down spout biasing the down spout extension in the stored position, the external spring having a first end and a second end, the first end being secured to the down spout extension and the second end being secured to the eave trough down spout, the spring tension being set such that a flow of water through the eave trough down spout provides a force which overcomes the biasing force of the spring thereby pivoting the down spout extension to the operative position.

2. The method as defined in claim 1, further comprising the step of sealing the connection between the down spout extension and the eave trough down spout, thereby preventing water flowing from the eave down spout from bypassing the down spout extension.

* * * * *